US005971899A

United States Patent [19]

Towley, III et al.

[11] Patent Number: 5,971,899

[45] **Date of Patent: *Oct. 26, 1999**

[54] EXERCISE WEIGHT SYSTEM

[75] Inventors: Carl K. Towley, III, Severn, Md.; Gregory S. Olson, Owatonna, Minn.

[73] Assignee: Intellbell, Inc., Owatonna, Minn.

[ * ] Notice: This patent is subject to a terminal disclaimer.

[21] Appl. No.: 09/099,612

[22] Filed: Jun. 19, 1998

Related U.S. Application Data

[63] Continuation of application No. 08/678,468, Jul. 3, 1996, Pat. No. 5,769,762, which is a continuation-in-part of application No. 08/610,512, Mar. 4, 1996, Pat. No. 5,779,604, which is a continuation of application No. 08/186,937, Feb. 2, 1994, abandoned, which is a continuation-in-part of application No. 08/013,785, Feb. 5, 1993, abandoned.

[51] Int. Cl.[6] ..... A63B 21/075

[52] U.S. Cl. ..... 482/108; 482/107

[58] Field of Search ..... 482/50, 908, 92–94, 482/97–109

[56] References Cited

U.S. PATENT DOCUMENTS

| | | | |
|---|---|---|---|
| 4,743,017 | 5/1988 | Jaeger | 482/108 |

FOREIGN PATENT DOCUMENTS

| | | | |
|---|---|---|---|
| 1659073 | 6/1991 | U.S.S.R. | 482/108 |
| 1687271 | 10/1991 | U.S.S.R. | 482/108 |
| 1755825 | 8/1992 | U.S.S.R. | 482/106 |

*Primary Examiner*—John Mulcahy
*Attorney, Agent, or Firm*—James W. Miller

[57] ABSTRACT

An exercise weight system for providing an adjustable exercise resistance or mass comprises a plurality of individual weights. Each weight includes two spaced plates joined in a rigid manner by at least one interconnecting member. The weights can be nested together in a horizontal weight stack such that a connecting pin inserted through the weight stack can select one or more weights for use as the exercise mass. In one embodiment, the interconnecting member is a channel having overlying front and back walls. A plurality of sets of aligned holes and slots are placed in these walls with each set having a uniquely different hole and slot arrangement. The pin can be inserted through any one set of holes and slots to couple a desired number of weights together for use.

10 Claims, 8 Drawing Sheets

FIG. 20
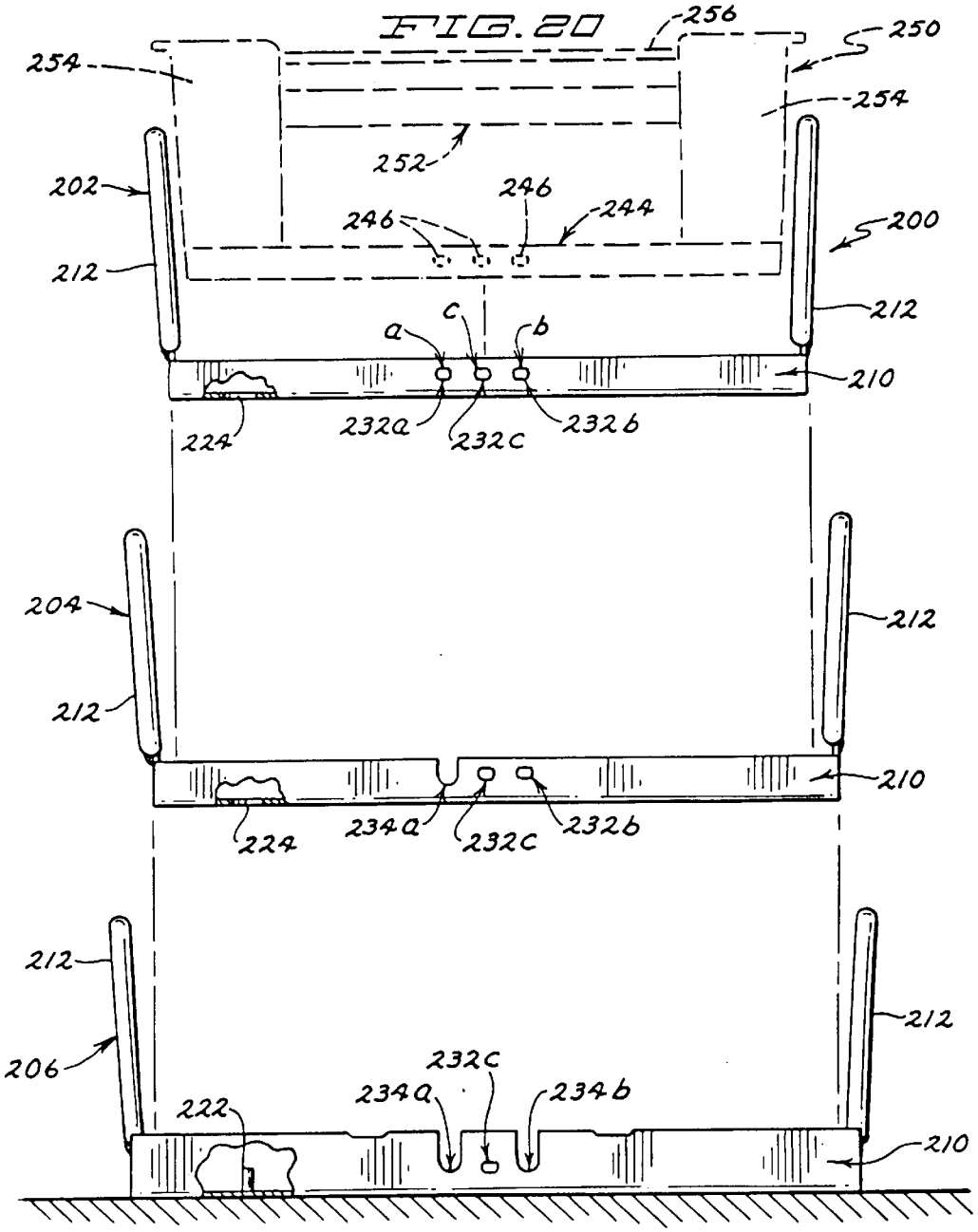
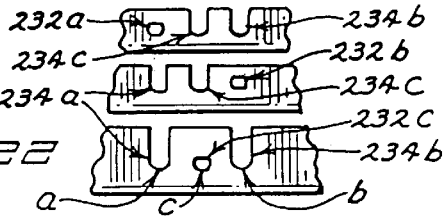
FIG. 22

EXERCISE WEIGHT SYSTEM

CROSS REFERENCE TO RELATED APPLICATIONS

This application is a continuation of application Ser. No. 08/678,468, filed Jul. 3, 1996, now U.S. Pat. No. 5,769,762, and is a continuation-in-part of application Ser. No. 08/610,512, filed Mar. 4, 1996, now U.S. Pat. No. 5,779,604, which is a continuation of application Ser. No. 08/186,937, filed Feb. 2, 1994, abandoned, which is a continuation-in-part of application Ser. No. 08/013,785, filed Feb. 5, 1993, abandoned.

TECHNICAL FIELD

This invention relates to an exercise weight system for providing an adjustable exercise resistance or mass. More particularly, this invention relates to such an exercise weight system that is of improved, compact construction and which may be incorporated as part of an adjustable barbell or dumbbell.

BACKGROUND OF THE INVENTION

Modern dumbbells have a long and interesting history. The earliest record of a dumbbell was the stone "halters" used by the ancient Greeks and Romans to train their long jumpers. They were carried and dropped at lift off, and it was thought that the sudden release of the halters resulted in the athlete jumping a greater distance.

During the 1700's and 1800's the wooden Indian club (pin) was popular as a gentlemen's physical culture device. These clubs were available in different weights and like the modern fixed weight dumbbell, were complete with a rack for storage. The heaviest Indian club was approximately thirty-five pounds. Considering that the athlete always grasped the club at its end, the use of a thirty-five pound pin was quite a demonstration of fore-arm strength.

The advent of the modern strongman in the late 1800's saw the development of the kettle bell. Like the Indian club, the bell forced the athlete to grasp an unbalanced weight resembling a bowling ball with a handle. Considerable skill, balance and strength was required to lift a kettle bell, the heaviest of which was in the 200–300 pound range.

Early balanced iron dumbbells became available after the turn of the century, with adjustable dumbbells being introduced by Milo Stanborn just before World War II.

Today, dumbbells are generally recognized as the most efficient of strength training devices. They allow extreme flexibility in patterns of movement and allow the athlete to perform a real world training regimen unlike, for example, bungee cord exercises. Therapists like to utilize dumbbells because they reflect of everyday movements and their flexibility allows the patient to train around joint and muscle trauma. Athletes that train with dumbbells enjoy productive gains not available with other training modalities because they require balance and involve synergistic muscle groups to contract during the lift. The necessity to balance the dumbbells and coordinate movement of each hand stress the muscular and nervous system unlike any machine exercise. With machines, a portion of the athlete's musculature can actually relax due to the absence of fully balanced coordination, i.e. one side can push harder than the other.

There are two basic forms of dumbbells: fixed or "pro-style", and adjustable dumbbells. Fixed dumbbells are individually compact, but are typically sold in sets which must be stored on a rack that is bulky and cumbersome. Adjustable dumbbells have historically incorporated plates and locking collars secured to the ends of an extended handle.

Adjustable dumbbells are the most space and cost efficient exercise equipment. However, they are not without some drawbacks. One drawback is the time it takes to change of adjust both dumbbells. Removing and replacing the locking collars and plates is,time consuming, and can be a potential safety hazard if the collars are not securely tightened. Another drawback is that it is difficult to perform a "kickup" due to the protruding end of the handle. Some exercises such as bench presses, inclines and shoulder work typically begin and end with the dumbbells resting on the knees of the athlete. However, this can be unwieldy and painful if the ends of the dumbbells are not relatively flat.

Various adjustable dumbbells have been developed heretofore. U.S. Pat. Nos. 4,948,123 and 4,556,690 to Schook, 4,913,422 to Elmore et al, 4,900,016 to Caruthers, 4,880,229 to Broussard, 4,743,017 to Jaeger, and 4,529,198 to Hettick are representative of the prior art in this regard. Each of these references, however, addresses only certain aspects of an adjustable dumbbell, such as releasability, interlocking of the weights, etc.

There is still a need for an adjustable dumbbell of improved construction which is not only compact in size, but also easily and securely comfortable to use without the clutter of loose weights.

Apart from the field of dumbbells, existing exercise machines have long used vertical weight stacks to provide an adjustable exercise resistance or mass. These weight stacks had a selector pin that could be inserted beneath one of the weights in the stack, such that the selected weight and all the weights above the selected weight would collectively comprise the exercise resistance or mass. However, weight stacks that provided a large exercise resistance, on the order of a couple of hundred pounds or so, became extremely tall. Thus, the size and cost of the exercise machine utilizing such a weight stack increased.

In addition, on existing exercise machines with vertical weight stacks, the position of the selector pin varies according to the selected weight. The higher the weight, the lower the pin position within the stack. It is quite difficult on many leg extension machines to insert the selector pin into the lowest weight stack hole from a seated position on the machine. Thus, existing vertical weight stacks and selector pins can be cumbersome and inconvenient to use.

Thus, there is still a need in the field of exercise equipment generally to provide a simpler and more compact weight stack that can be more easily adjusted.

SUMMARY OF THE INVENTION

One aspect of this invention provides an exercise weight system formed in a compact manner for providing an adjustable exercise mass. Such a system comprises a plurality of individual weights. Each weight comprises a pair of spaced apart weight plates including a first substantially vertical weight plate spaced from a second substantially vertical weight plate by a predetermined distance. At least one interconnecting member extends between and is rigidly affixed to the first and second weight plates for rigidly joining the weight plates together, the weight plates and interconnecting member(s) of each weight being separate and distinct from the weight plates and interconnecting member(s) of the other weights such that the weight plates and interconnecting member(s) of each weight form a single unit. The predetermined distance between the first and second weight plates of successive weights is progressively longer from an innermost weight to an outermost weight such that the weights can be nested together in a horizontally extending stack with the first weight plates being nested together on one side of the horizontal stack and the second weight plates being nested together on the other side of the horizontal stack. Finally, a means is provided for selecting a desired number of weights for joint use, wherein the selecting means is adjustable to allow the user to select different numbers of weights for joint use, thereby to adjust the exercise mass.

Another aspect of this invention is the provision of a novel connecting means for use with an exercise weight system. This aspect is provided in an exercise weight system comprising a plurality of individual weights having overlying portions. A plurality of sets of aligned holes and slots are placed in the overlying portions, wherein each set has a unique arrangement of holes and slots. A connecting pin selectively insertable through any one set of holes and slots to select for use a particular weight or weights as determined by the hole and slot arrangement in the set through which the pin passes.

BRIEF DESCRIPTION OF THE DRAWINGS

A better understanding of the invention can be had by reference to the following Detailed Description in conjunction with the accompanying Drawings, wherein:

FIG. 20 is a front elevational view of the exercise weight system of FIG. 17 with the components thereof being shown in a vertically exploded form for the sake of clarity, particularly illustrating a first hole and slot configuration according to the invention;

FIG. 22 is a partial front elevational view similar to FIG. 20, particularly illustrating a second hole and slot configuration according to the invention.

DETAILED DESCRIPTION

Figure 1:
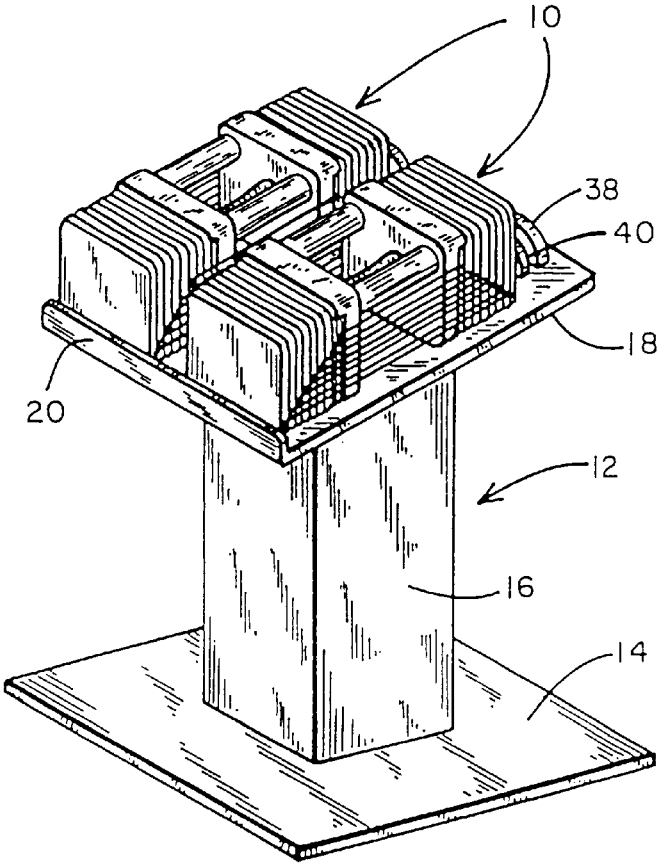
FIG. 1 is a perspective view of an adjustable dumbbell incorporating a first embodiment of the invention, shown on a stand, the dumbbell incorporating an exercise weight system for providing an adjustable exercise resistance or mass.

Referring now to the Drawings, wherein like reference numerals designate like or corresponding elements throughout the views, and particularly referring to FIG. 1, there is shown a pair of adjustable dumbbells 10 incorporating the invention. The dumbbells 10 are shown on a stand 12 including a base 14, column 16 and inclined top tray 18. The upper surface of tray 18 is preferably coated or lined with an elastomeric material for skid resistance and noise reduction. A lip 20 is provided at the lower edge of tray 18 to prevent the adjustable dumbbells 10 from slipping off the stand 12. The stand 12 is preferably formed of sheet metal, with the top tray 18 tilted and elevated for convenient access by an athlete. As will be explained more fully hereafter, the adjustable dumbbells 10 incorporate a unique nested handle and weight arrangement for more compact construction, and a unique exercise weight system for providing an adjustable exercise resistance or mass.

Figure 3:
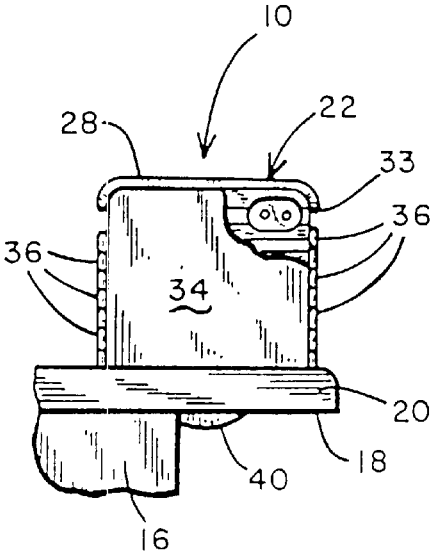
FIG. 3 is an end view thereof.
Figure 2:
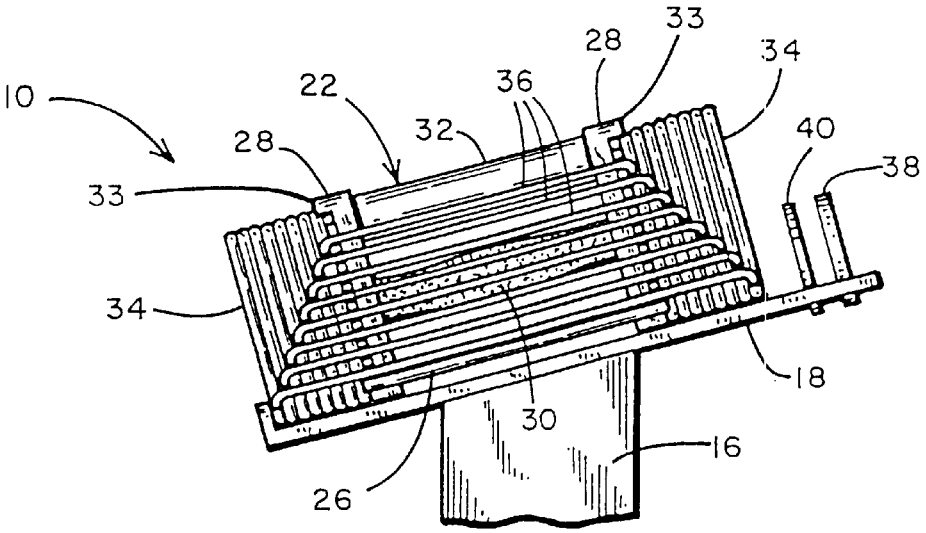
FIG. 2 is a side view of the adjustable dumbbell herein.
Figure 4:
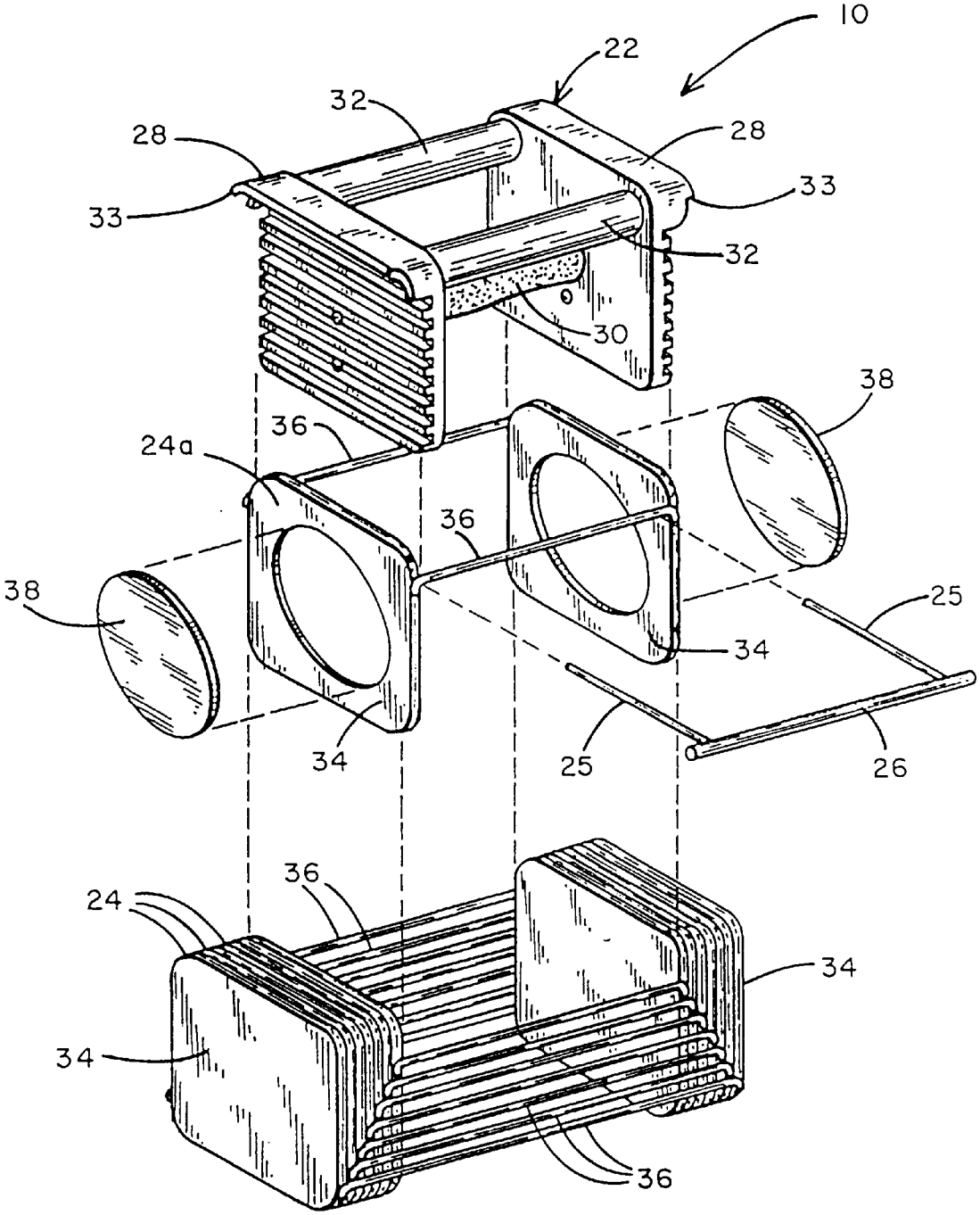
FIG. 4 is an exploded perspective view thereof.

Referring to FIGS. 2–4, the adjustable dumbbell 10 includes a central handle 22 selectively connected to one or more of a plurality of nested outer weights 24 by means of a selector pin 26. The handle 22 includes a pair of longitudinally spaced apart ends 28 interconnected by a generally centrally located grip 30 and a pair of laterally spaced apart crosstubes 32. The grip 30 is preferably coated or surrounded by a sleeve of foam material for comfort. Since the crosstubes 32 contact the wrists of the athlete during use of the dumbbell 10, they are also preferably coated or encased with a similar foam material for comfort.

If desired, the grip 30 and crosstubes 32 can be mounted for adjustability. The grip 30 is shown in a position substantially coincident with the center of gravity of the dumbbell 10. However, if desired, an alternate offset mounting position can be provided as best seen in FIG. 4 in order to create some leverage so as to effectively increase the training resistance. Similarly, alternate mounting positions for the crosstubes 32 can be provided as shown for adjusting the spacing therebetween in accordance with the wrist size of the athlete, as best seen in FIG. 3.

The handle 22 fits inside a nested arrangement of weights 24. In the preferred embodiment, eight such weights 24 are provided, each weighing about ten pounds for a total of eighty pounds. Any desired combination of weights can be used. For example, five weights 24 each weighing about five pounds for a total of twenty five pounds, could be used. Outward lips or projections 33 are provided on the ends 28 of handle 22 for contacting the first innermost weight 24, which is in contact with each successive weight.

In particular, each weight includes two longitudinally spaced apart end plates 34 interconnected by a pair of side rails 36. Each side rail 36 includes a generally straight middle portion with downwardly turned ends, which are preferably welded to the rounded peripheral edge of the respective plate 34. The side rails are also preferably spaced slightly outward form the edges of plates 34 to facilitate nesting. The end plates 34 are preferably generally square or rectangular with rounded edges and are of about the same size, weighing about five pounds each. The side rails 36 interconnecting the end plates 34 of the same weight 24 are of the same length, but are of different relatives lengths and positioned in vertically offset relationship between adjacent weights so as to form a nested stack as shown with sufficient space between adjacent side rails to receive the selector pin 26. The side rails 26 for the innermost weight 24 are shortest and closest to the top of handle 22, while the side rails of each successive weight are progressively longer and farther downward. The ends of each side rail 26 normally rest on the side rail of the next weight 24 below it so that the handle 22 is in direct contact with and through each weight 24.

The outer ends 28 of handle 22 are preferably grooved as shown for receiving the sides or prongs 25 of the selector pin 26. This helps to distribute shear stress for more safety. Accordingly, insertion of the selector pin 26 beneath the side rails 36 connects that weight 24 and any weights above it to the handle 22 for movement therewith. In other words, the selector pin 26 serves to connect a given weight 24 and any other innermost weight(s) inwardly thereof to the handle 22 in accordance with the training resistance desired. The rest of the outermost weights 24 remain together in a stacked/nested configuration on the floor or stand 12 when not in use. This comprises a significant feature of the invention.

Referring particularly to FIG. 4, the end plates 34 of the innermost weight 24A may include recesses or apertures as shown for receiving supplemental weights 38 which would be captured in position by the handle 22. This would provide some intermediate adjustment between the ten pound increments of weights 24. For example, the supplemental weights 38 could each be about two and one-half pounds. If desired, another set of supplemental weights 40 of a different size, such as about one and one-quarter pounds each in order to provide a total two and one-half pounds adjustment, as shown in FIGS. 1 and 2, could be provided for additional flexibility.

Both the end plates 34 of weights 24 and the ends 28 of handle 22 are preferably angled slightly outwardly, such as about three degrees, for safety purposes to prevent disconnection from the handle 22 if pin 26 should come out while the dumbbell is inverted or overhead. This also promotes ease of use when racking or renesting and eliminates the need for secondary tracking methods, thus reducing cost and complexity.

Figure 5:
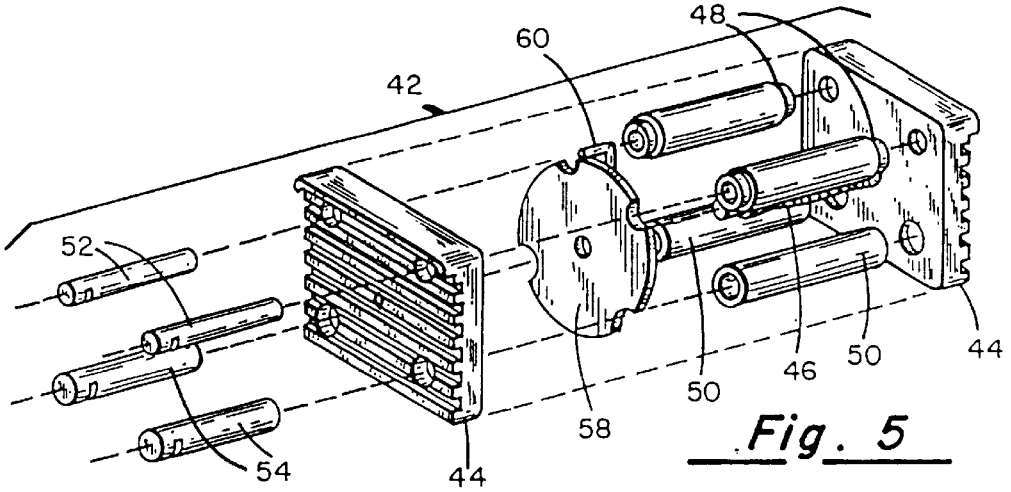
FIG. 5 is an exploded perspective view of an alternate handle construction.
Figure 6:
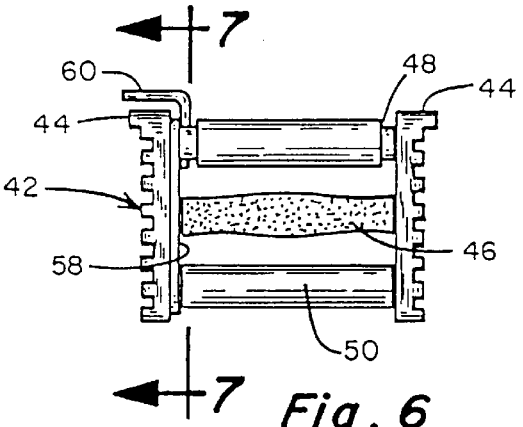
FIG. 6 is a side view thereof.
Figure 7:
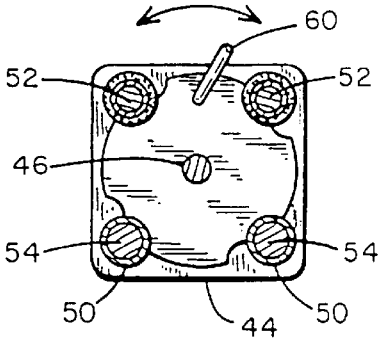
FIG. 7 is a sectional view taken along lines 7—7 of FIG. 6 in the direction of the arrows.

FIGS. 5–7 show an alternate handle 42 which provides even more flexibility in adjustment. The handle 42 includes a pair of longitudinally spaced apart ends 44 which are grooved across their outer surfaces similar to ends 28 of handle 22. A central grip 46 similar to grip 30 is likewise secured between the ends 44. However, the handle 42 incorporates four hollow crosstubes 48 and 50 extending between the corners of the ends 44, which crosstubes are closed at one end and open at the other through openings in that end 44 for receiving cylindrical ballast weights 52 and 54 therein. In accordance with the preferred embodiment, the crosstubes 48 and 50 are of different sizes for respectively receiving ballast weights 52 and 54 of different relative sizes. For example, each ballast weight 52 can weigh about 0.75 pound, while each ballast weight 54 can weight about 1.25 pound. Further, each of the ballast weights 52 and 54 includes a circumferential recess or groove for receiving the periphery of a locking disc 58 which is rotatable about the grip 46 by means of lever 60 in order to secure the weights within the handle 42. As shown, the periphery of the locking disc 58 includes four cutouts which cooperate with adjacent circumferential slots in the crosstubes 48 and 50 so as to selectively secure the ballast weights 52 and 54 within the handle 42. The handle 42 can thus be used either alone or with one or more weights 24. Further, any combination of ballast weights 52 and 54, either alone or together with one or both of the others, can be used to achieve the desired degree of adjustment and leverage for most effective training.

Figure 8:
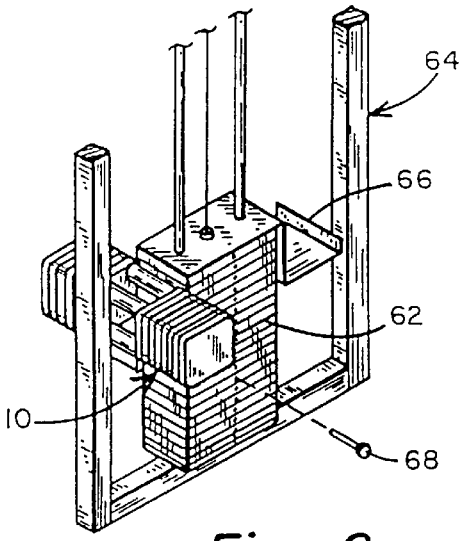
FIGS. 8 and 9 are illustrations showing the adjustable dumbbell herein utilized in conjunction with a conventional weight stack in an exercise machine.
Figure 9:
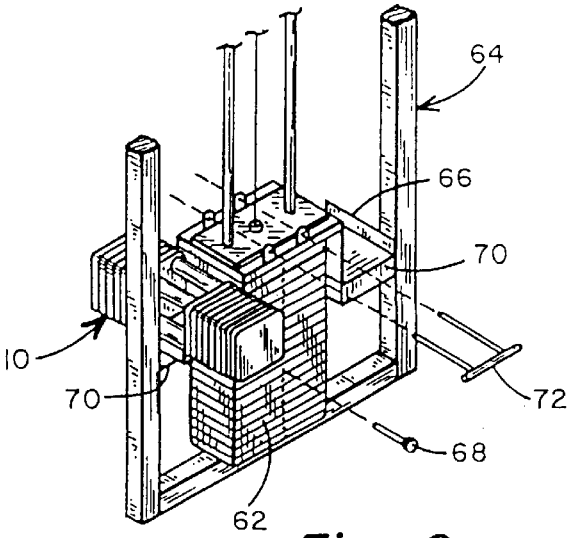

FIGS. 8 and 9 illustrate usage of the dumbbell 10 in conjunction with a conventional weight stack 62 in an exercise machine 64. In FIG. 8, the adjustable dumbbells 10, only one of which is shown, are set on a tray 66 extending over the top weight in the weight stack 62 in order to supplement whatever amount of weight is selected by means of pin 68. FIG. 9 shows a modified tray 66 which is normally supported of frame extensions 70 of the exercise machine 64, but which can be selectively connected to the top most weight in the weight stack 62 by means of pin 72 so that exercise machine 64 can be used either with or without the supplemental weight of the adjustable dumbbells 10.

Figure 10:
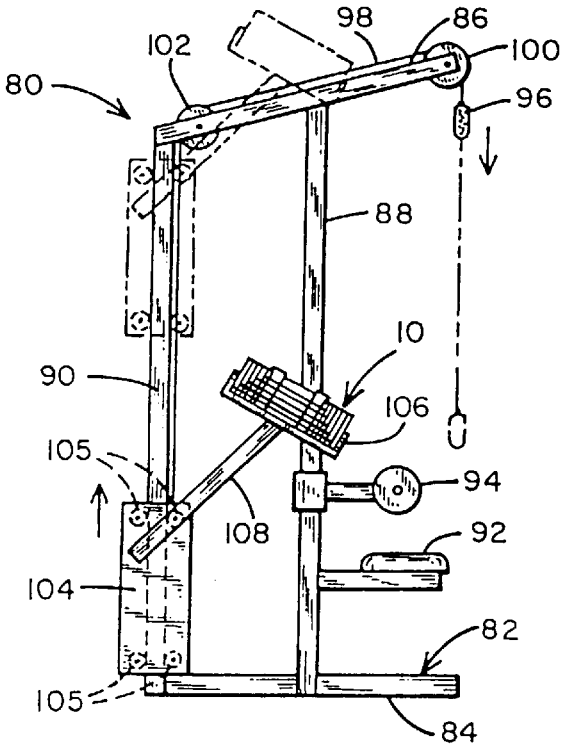
FIG. 10 is a side view of an exercise machine incorporating the adjustable dumbbell herein as the primary resistance.
Figure 11:
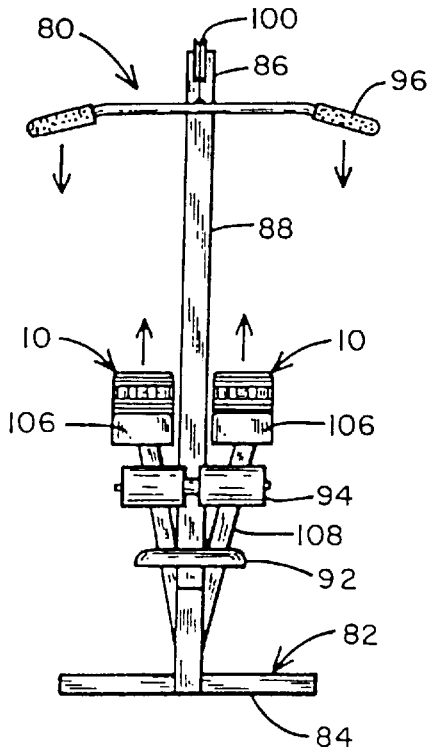
FIG. 11 is a front view thereof.

If desired, the adjustable dumbbell 10 herein could be adapted for use as the primary resistance, instead of as a supplement to a weight stack or other resistance, in an exercise machine. Referring to FIGS. 10 and 11, there is shown an exercise machine wherein a pair of dumbbells 10 are utilized as the primary resistance. As illustrated, the exercise machine 80 comprises a lat pull-down machine. However, the adjustable dumbbells 10 herein could be incorporated into other types of exercise machines wherein adjustable weight training resistance is desired.

The exercise machine 80 includes a frame 82 comprising a base 84 and a boom 86 interconnected by a pair of columns 88 and 90. A seat 92 and a padded hip catch 94 are secured to the front column beneath a handle 96. The handle 96 is connected to the end of a cable 98 extending over pulleys 100 and 102 on the boom 86. The other end of the cable 98 is connected to a movable shuttle 104 which is constrained for movement along column 90 by rollers 105. Each dumbbell is supported on a tray 106 secured to an arm 108 on the common shuttle 104. The arms 208 are angled forward and upward as shown for convenient access to dumbbells 10 in trays 106 by an athlete from the front of machine 80, travelling along the sides of column 90 between a lowered position shown in solid lines and a raised position shown in phantom lines. This configuration also allows for a more compact construction requiring less floor space and less overhead clearance. The training resistance of the exercise machine 80 can thus be easily adjusted by means of dumbbells 10 which can also be removed and used separately.

If desired, the trays 106 could be positioned directly on the shuttle 104 without arms 108, although such arrangement would not as accessible from the front of machine 80.

Figure 12:
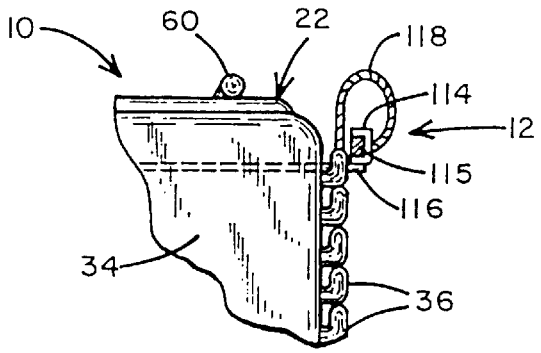
FIG. 12 is an enlarged partial end view of an alternate selector pin construction.

FIG. 12 illustrates an alternate selector pin 112. In particular, the selector pin 112 includes a channel section 114, a pair of magnets 115 therein, and a generally U-shaped portion 116. The U-shaped portion 116 includes a pair of prongs that extend substantially across the width of dumbbell 10 similarly to the prongs of pin 26. The use of magnets 115 helps to positively secure the selector pin 112 in place and against accidental displacement. If desired, an elastic tether 118 can also be used for additional safety. The tether is preferably secured between the channel 114 of pin 112 and one side rail 36 of the innermost weight 24.

Figure 13:
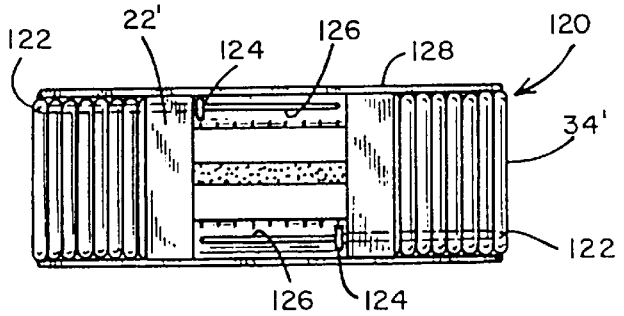
FIG. 13 is a top view of an adjustable dumbbell incorporating a second embodiment of the invention.
Figure 14:
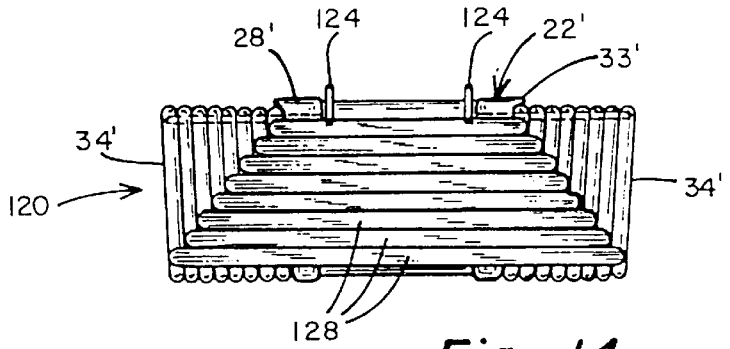
FIG. 14 is a side view thereof.

FIGS. 13 and 14 show and adjustable dumbbell 120 incorporating a second embodiment of the invention. The dumbbell 120 incorporates numerous components parts which are substantially similar to component parts of the dumbbell 10 herein. The same reference numerals have been used to identify such components parts, but with prime (') notations for differentiation.

The primary difference between the adjustable dumbbells 10 and 120 resides in the means by which the amount of weight is selected. In contrast to the dumbbell 10 which utilizes a side selector pin, the dumbbell 120 incorporates a pair of rigid pins 122 internal to the handle 22' which can be selectively advanced outwardly in opposite longitudinal directions into engagement with weights 24' in accordance with the weight desired. The pins 122 are slidably contained within crosstubes 32' for movement between a retracted position inside the handle 22' and positions projecting outwardly through aligned holes (not shown) in the ends 28' of the handle and the end plates 34' of weights 24'. Thumb tabs 124 are connected to the inner ends of the pins 122 through longitudinal slots 126 along the tops of crosstubes 32'. If desired, some form of detent arrangement could be utilized to secure pins 122 and thumb tabs 124 in positions corresponding to different predetermined weight selections.

In addition to the manner by which the desired weight is selected, the dumbbell 120 also incorporates different side rails 128 interconnecting the end plates 34' of weights 24'. Each side rail 128 is of generally flat, strap-like configuration in normal contacting stacked relationship as shown. Otherwise, the dumbbell 120 is substantially similar in construction and function to the dumbbell 10.

Figure 15:
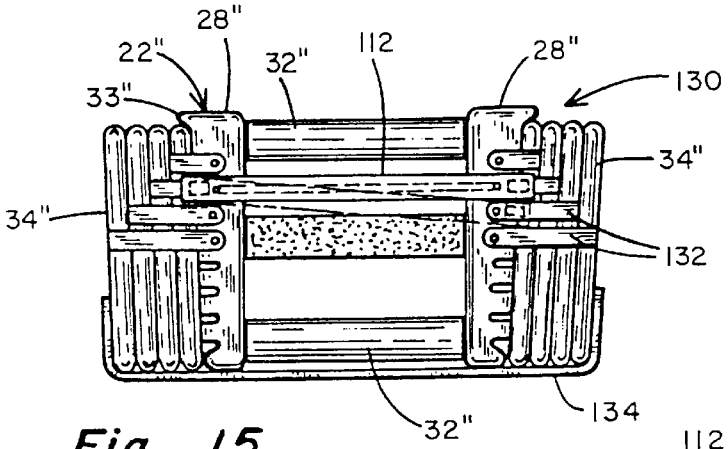
FIG. 15 is a side view of an adjustable dumbbell incorporating a third embodiment of the invention.

FIG. 15 shows a dumbbell 130 incorporating a third embodiment of the invention. The dumbbell 130 incorporates numerous components parts which are substantially similar to component parts of the dumbbell 10 herein. The same reference numerals have been used to identify such components parts, but with double prime (") notations for differentiation.

The primary difference between the dumbbells of the first and third embodiments herein resides in the fact that dumbbell 130 incorporates weights 24" whose opposing end plates 34" are not continuously connected. In particular, each plate 34" includes opposing pairs of longitudinal side tabs 132 with apertures of receiving the prongs on pin 26 or 112. The end plates 34" of each weight 24" are thus normally nested but not connected. The end plates 34" of weights 24" are only connected by the selector pin when and in accordance with the weight selection desired. The other innermost weights 24" are of course captured between the particular weight selected and handle 22" as before, while the other outer weights remain in a nested and stacked arrangement when not in use. Some sort of retainer, such as lower tray 134 is necessary with this embodiment in order to keep the remaining weights 24" from falling outward when not in use. The primary advantage of this embodiment is greater versatility in that the pin 112 can be connected not only between the tabs 132 of corresponding weights 24", but also the tabs on the end plates 34" of adjacent weights as shown in phantom lines, for adjustability. The holes in tabs 132 are somewhat enlarged or loose to provide the necessary tolerance for such cross pinning. Otherwise, the dumbbell 130 is substantially similar in construction and function the dumbbell of the first embodiment herein.

Figure 16:
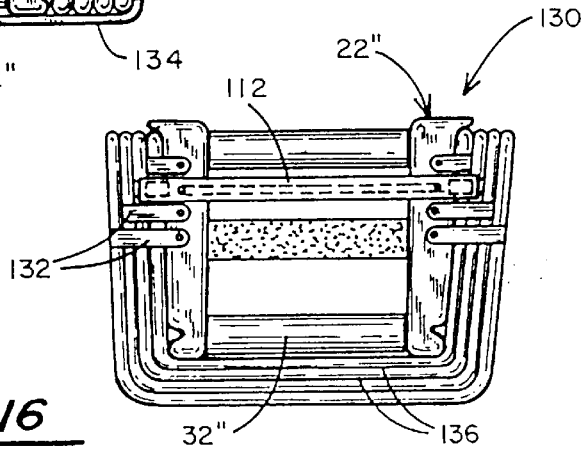
FIG. 16 is a side view of a modification thereof.

FIG. 16 illustrates a modification of the dumbbell 130 including end plates 34" that are connected at their bottoms 136. Such weights 24" can be constructed by conventional forming or stamping techniques in the manner of breadpans. Since the end plates 34" of each weight 24" are connected at their bottom, no additional retainer such as tray 134 would be required.

From the foregoing, it will thus be apparent that the present invention comprises an adjustable dumbbell having several advantages over the prior art. The dumbbell is of compact construction and is easily adjustable, growing in length with weight. The unused weights remain nested in an orderly stack in one place, rather than lying about loose. Other advantages will be apparent to those skilled in the art.

Referring now to FIGS. 17–22, an exercise weight system for providing an adjustable mass is generally shown as 200. Exercise weight system 200 was originally conceived as a way of adding additional amounts of weight, selected by the user, to any of the adjustable dumbbells shown in FIGS. 1–16. It was apparent to the Applicants that being able to increase the maximum weight of the dumbbell would be desirable to some users. Simply adding further nested weights of the type shown in FIGS. 1–16 to the dumbbell is not optimal in accomplishing this objective because it increases the height of the dumbbell. Increasing the height of the dumbbell much beyond what is shown in FIGS. 1–16 is not preferred because it begins to give the user the impression of lifting a large box rather than a compact dumbbell. In addition, the taller the dumbbell, the more difficult it is to balance particularly when the dumbbell is being used in a pressing motion.

Exercise weight system 200 allows additional weight to be added to the dumbbell with an increase in the length of the dumbbell without a commensurate increase in the height of the dumbbell. Thus, exercise weight system 200 adds additional weight to the dumbbell while retaining a compact height for the dumbbell. In fact, the rectangular form of the dumbbell is enhanced using exercise weight system 200. The dumbbell becomes progressively longer when the various weights of exercise weight system 200 are in place, but its height does not change substantially. Thus, a dumbbell equipped with exercise weight system 200 still has a preferred rectangular shape and a compact height.

While exercise weight system 200 was originally developed as a kit for use with the dumbbells of FIGS. 1–16, it is not limited to that use. In fact, exercise weight system 200 involves a plurality of weights and a novel hole and slot arrangement for securing the weights together in various combinations that is useful on its own simply to provide an adjustable exercise resistance or mass. Thus, exercise weight system 200 could be used as the weight stack on an exercise bench and need not be used merely as a kit to extend the weight of the dumbbells shown in FIGS. 1–16. Alternatively, exercise weight system 200 can be used in conjunction with a simple handle 250 to itself form an adjustable dumbbell without requiring the particular types of nested weights and securing methods used in the dumbbells of FIGS. 1–16. Thus, exercise weight system 200 forms a further significant advance in the art.

Exercise weight system 200 includes a plurality of weights 202, 204 and 206 that may be used in various combinations to form an adjustable exercise mass. While three such weights 202, 204 and 206 are shown in exercise weight system 200, a greater or lesser number of weights could be used. The precise number of weights used in exercise weight system 200 is not important although a plurality of weights, i.e. at least two, will normally be used in exercise weight system 200.

Each exercise weight 202, 204 and 206 includes a horizontal base in the form of a shallow, upwardly facing tray or channel 210 that rigidly supports two end plates 212, one on either end. End plates 212 thus are spaced apart relative to one another by the length of supporting base channel 210.

End plates 212 are preferably generally square or rectangular with rounded edges and are of about the same size. End plates 212 are slightly outwardly inclined as best illustrated in FIG. 20 in the same manner as end plates 34.

When exercise weight system 200 comprises a kit to add weight to one of the dumbbells shown in FIGS. 1–16, end plates 212 will be shaped and oriented to match the size, shape and outward inclination of end plates 34 of the weights in the dumbbell. However, this is not strictly necessary. For example, if exercise weight system 200 does not form part of a kit for the dumbbells of FIGS. 1–16, the sizes and shapes of end plates 212 could obviously vary from that of end plates 34. Preferably, the sizes, shapes and outward inclination, if any, of end plates 212 within exercise weight system 200 would still preferably match one another to present a uniform appearance.

Because end plates 212 are secured at their lower extremity to base channel 210, it would be possible for end plates 212 to have a circular shape. While circular end plates 34 could have been used in dumbbell 10 for example, rectangular plates were preferred because side rails 36 were attached to the sides of plates 34. With round plates 34 and side rails 36, one could attach such side rails 36 only to the lower half of plates 34, thus giving up half the adjustment height. However, this problem does not exist with the use of bottom base channels 210, and thus end plates 212 could easily be made in a round or circular shape, thus allowing exercise weight system 200 when incorporated into a dumbbell to mimic the shape of a conventional dumbbell with round weights.

Each end plate 212 weighs approximately five pounds. Thus, each individual weight 202, 204 and 206 in exercise weight system 200, comprising one base channel 210 and the two end plates 212 joined to channel 210, will provide an incremental weight of approximately ten pounds or so. Obviously, this can be varied if so desired so that the weights 202, 204 and 206 provide more or less than ten pounds each by adjusting the amount each end plate 212 weights. In addition, different ones of the individual weights 202, 204 and 206 could provide different amounts of incremental weight. For example, weight 202 could provide ten pounds, weight 204 could provide fifteen pounds, etc.

Figure 21:
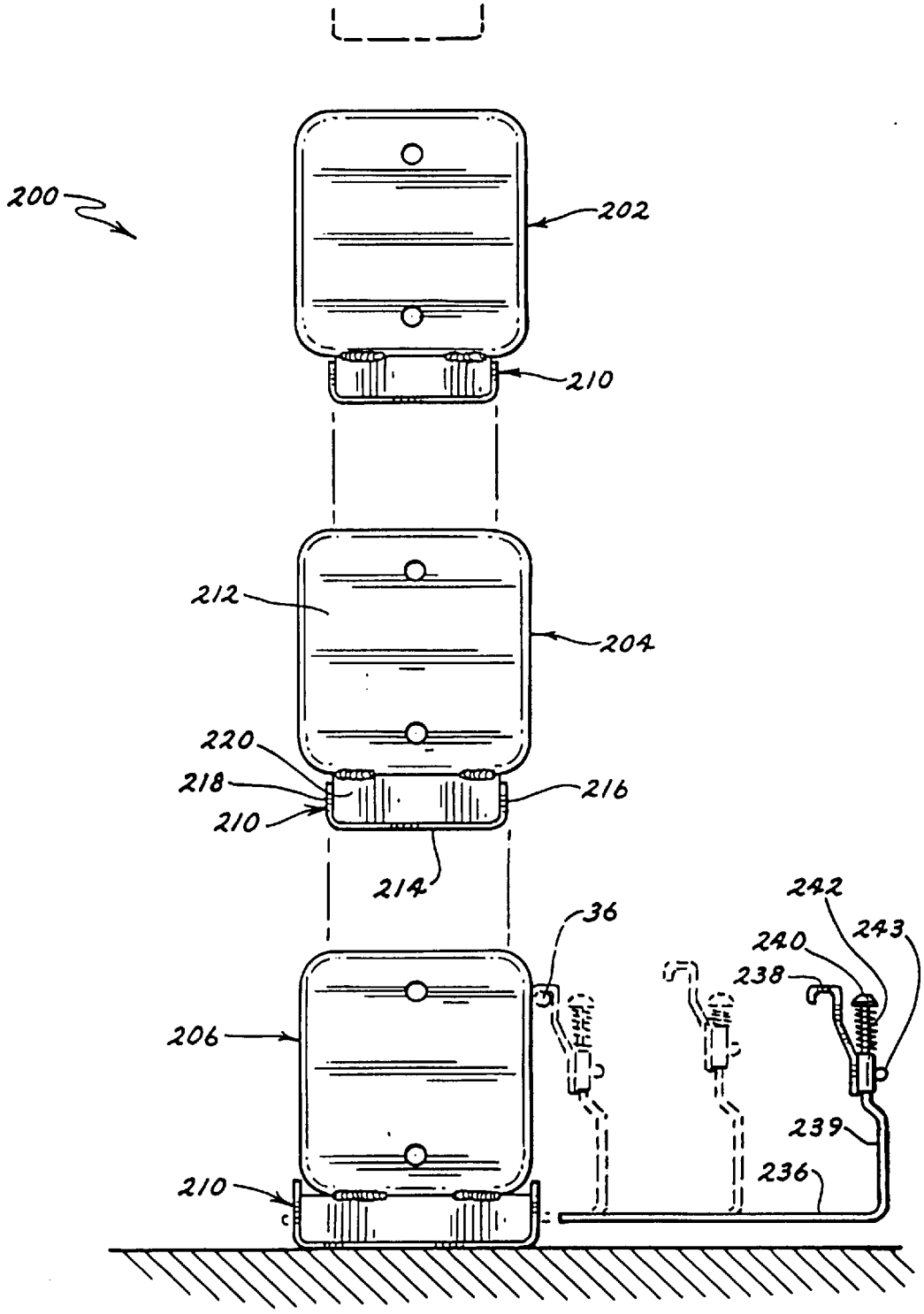
FIG. 21 is an end elevational view of the exercise weight system of FIG. 17 with the components thereof being shown in a vertically exploded form for the sake of clarity.

Base channel 210 of each exercise weight 202, 204 and 206 comprises a substantially flat bottom wall 214 having short, upwardly extending front and back walls 216 and 218 and side walls 220. The front and back walls 216 and 218 abut at their ends to side walls 220 and may be rigidly affixed thereto, as by welding, for strength. End plates 212 are rigidly attached or affixed to base channel 210 in any suitable manner. As shown in FIG. 21, end plates 212 may be welded along their lower edges to the upper edges of the side walls 220. When so affixed, end plates 212 and base channels 210 form a rigid unit that in its entirety comprises one of the individual weights 202, 204 and 206 of exercise weight system 200.

Base channels 210 of the individual weights in exercise weight system 200 are progressively slightly narrower and shorter than one another from one channel to the next. This allows the weights to be nested together in the manner shown in FIGS. 17–21, with the weight 206 having the longest and widest channel 210 forming an outermost weight, the weight 202 having the shortest and narrowest channel 210 forming an innermost weight, and all of the other weights, such as weight 204, having channels 210 that progressively narrow and shorten relative to one another forming a series of intermediate weights. This allows the weights 202, 204 and 206 in exercise weight system to be nested together with their base channels 210 being nested inside of one another and end plates 212 generally abutting one another.

Front and back walls 216 and 218 of respective base channels 210 have slightly different heights, with walls 216 and 218 of innermost weight 202 being shortest and walls 216 and 218 of successive weights 204 and 206 each being slightly taller. The difference in height is chosen to accomodate the thickness of bottom wall 214 of base channels 210. Thus, when base channels 210 are nested together with bottom walls 214 of channels 210 being stacked vertically on top of one another, front and back walls 216 and 218 of all the channels 210 lie within the overall height of walls 216 and 218 on outermost weight 206. See FIG. 19. Thus, front and back walls 216 and 218 of nested weights 202, 204 and 206 do not pyramid above one another because they preferably are slightly shorter than one another.

While upwardly facing base channels 210 are shown forming the means for interconnecting and joining end plates 212, downwardly facing channels could have been used. In this configuration, innermost weight 202 would have the shortest and widest base channel 210, intermediate weight 204 would have a slightly longer and narrower base channel 210, and outermost weight 206 would have had the longest and and narrowest base channel 210.

The bottom wall 214 of the outermost weight 206 includes an upright guide pin 222 which extends through holes 224 in the bottom walls 222 of all the other channels 210. Pin 222 and holes 224 facilitate proper alignment of weights 202, 204 and 206 during a nesting operation. When a channel 210 or group of joined channels 210 are dropped down into the remaining channels, the pin 222 must be aligned with holes 224 to extend through holes 224 to help nest the whole assembly together and to prevent the weights from being inadvertently turned around 180 degrees. Guide pin 222 creates an interference preventing base channels 210 from nesting when they are improperly turned around. Without guide pin 222, weights 200, 204 and 206 could be nested in a "backward" fashion, giving false weight indicators.

Figure 17:
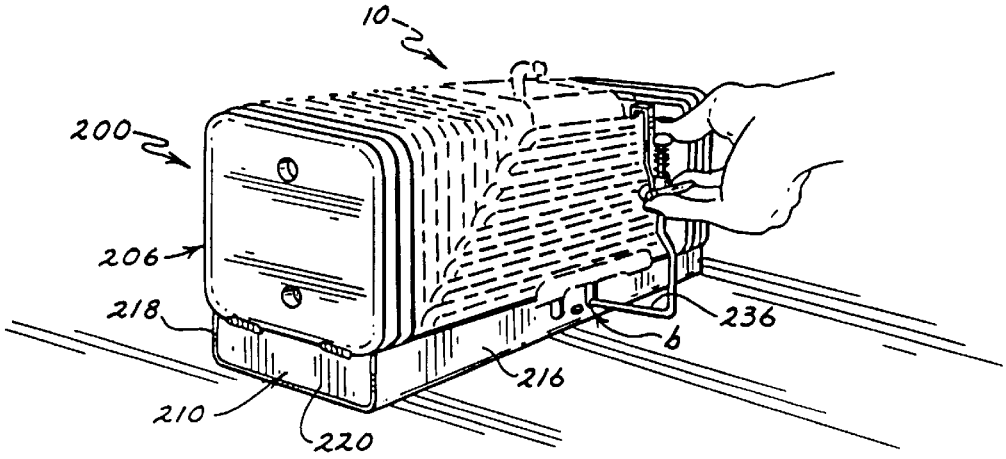
FIG. 17 is a perspective view of an exercise weight system for providing an adjustable mass, the exercise weight system being shown in FIG. 17 in the form of a kit for adding additional incremental weight to the adjustable dumbbells shown in any of the preceding embodiments of FIGS. 1–16.
Figure 18:
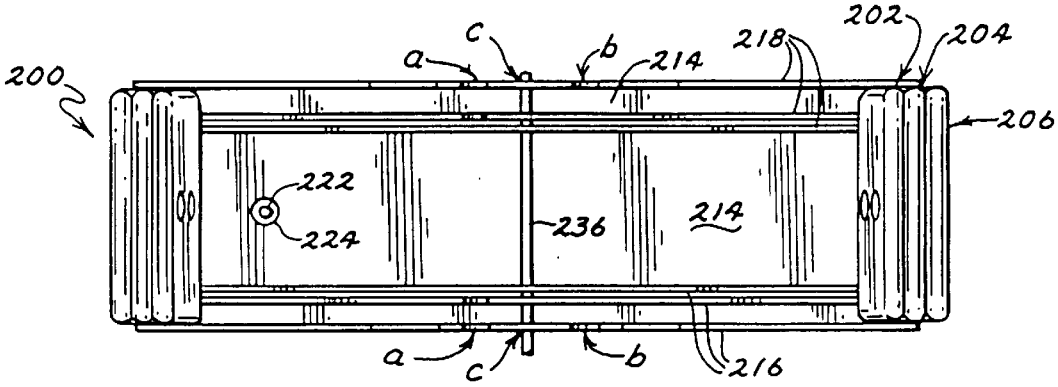
FIG. 18 is a top plan view of the exercise weight system of FIG. 17.
Figure 19:
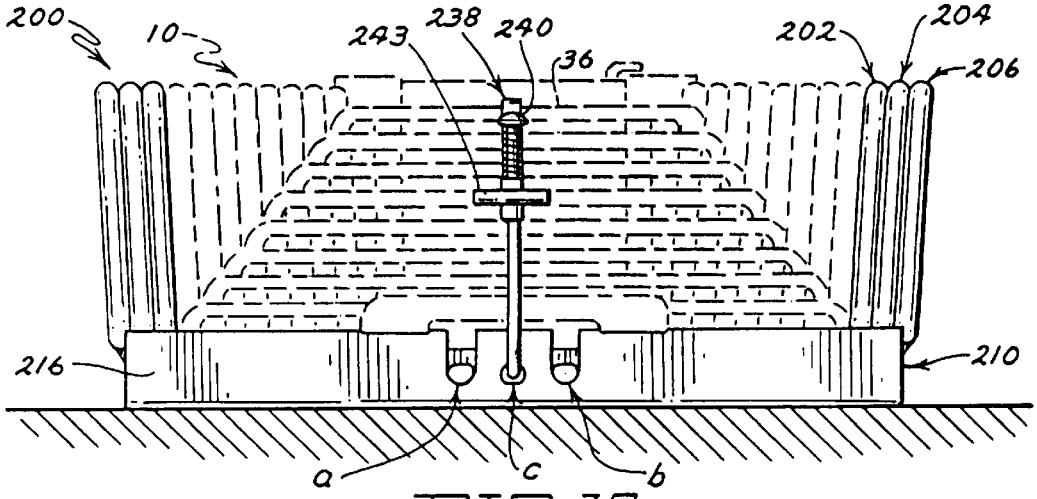
FIG. 19 is a front elevational view of the exercise weight system of FIG. 17.

Channels 210 have been described as being both slightly shorter and narrower than one another. Making channels 210 slightly shorter than one another allows end plates 212 to be conveniently attached to the ends of each channel. However, channels 210 could have the same length as long as they are slightly narrower than one another. In this event, end plates 212 could be attached to each channel 210 at slightly different longitudinal positions along the length of channel 210, rather than simply at the ends, to arrive at the abutting relationship of all the end plates 212 as shown in FIGS. 17–19. However, channels 210 must be slightly narrower than one another to allow them to be nested inside of one another as shown in the drawings.

When the weights 202, 204 and 206 of exercise weight system 200 are nested together, at least portions thereof overlap or overlie one another. When base channels 210 form part of the weights, the front walls 216 of the nested channels overlie one another to form a first group of overlying surfaces or portions and the back walls 218 of the nested channels overlie one another to form a second group of overlying surfaces or portions. An important part of exercise weight system 200 of this invention is the use of a novel connecting means that connects through these overlying portions, namely through the front and back walls 216 and 218 of the nested channels 210, to adjustably connect the weights together in desired different combinations. This connecting means is illustrated generally as 230.

Connecting means 230 comprises a series or plurality of sets a, b and c of aligned holes 232 and slots 234 placed in at least one group of overlying portions of the weights. Preferably, because of the shape of channel 210, these sets a, b and c are duplicated in each group of overlying portions, namely the sets a, b and c are placed both in the overlying front walls 216 of channels 210 and identical sets a, b and c are placed in the overlying rear walls 218. See FIG. 18. However, the base member used to connect the end plates 212 of each weight together might have other than a channel shape, such as a T-shape with a central vertical wall depending downwardly from the bottom wall, to provide only one group of overlying portions. In this case, only one series of sets a, b and c would be used placed in the overlying central vertical walls of such base members.

Holes 232 and slots 234 in each set a, b or c thereof are aligned with one another in a transverse direction perpendicular to the overlying portions so that an elongated connecting pin 236 can be pushed in a straight line motion through holes 232 and slots 234 in each set. Normally, when base channels 210 are nested together, only the outermost hole 232 or slot 234 in each set a, b or c is fully visible with the other holes 232 or slots 234 in each set being mostly hidden as shown in FIG. 19. However, referring to the exploded view shown in FIG. 20, each hole 232 and each slot 234 in each set can be seen, with the holes and slots in the same set having an identical a, b or c suffix to refer to the a, b or c set to which they belong.

As between the various sets a, b or c, the arrangement of holes 232 and slots 234 in each set a, b and c is unique is some way so that the insertion of pin 236 through holes 232 and slots 234 in one set will select a particular one or ones of the weights 202, 204 and 206 for use while the insertion of pin 236 through another set will select a different arrangement of weights for use. Thus, the user can select the weight combination he wants by choosing which single set a, b or c of aligned holes 232 and slots 234 to stick pin 236 through. FIG. 17 shows the user sticking pin 236 through set b.

Referring again to FIG. 20, the three sets of holes 232 and slots 234 are respectively shown as a, b and c. In FIG. 20, each set has a unique number of holes 232 and slots 234. For example, in set a, one hole 232*a* is provided in the innermost weight 202 and slots 234*a* are provided in intermediate weight 204 and outermost weight 206. In set b, one additional hole 232 and one fewer slot 234 is provided, namely holes 232*b* are provided in the innermost and the intermediate weights while a slot 234*b* is provided in the outermost weight. In the third or middle set of holes and slots 234, namely in set c, holes 232*c* are provided in all of the weights. Thus, set a is a one hole/two slot arrangement, set b is a two hole/one slot arrangement, and set c is a three hole/no slot arrangement.

The above described sets a, b and c of holes 232 and slots 234 are those arranged in at least one set of overlying portions of the weights, i.e. in the overlying front walls 216 of channel 210 for example. At least one series of these sets a, b or c is required. However, as shown in FIG. 18 and as described earlier, with pin 236 preferably extending all the way across channels 210 between the front and back walls 216 and 218, an identical series of sets a, b and c of holes and slots 234 is provided in the overlying back walls 218 as well. However, the connection provided by pin 236 need not necessarily extend all the way through the front and back channel walls, though this is preferred. Thus, at least one series a, b and c of sets of holes 232 and slots 234 is required in the front or back walls 216 or 218, or in other overlying surfaces or portions on the weights.

Turning now to how the aligned sets a, b or c of holes and slots 234 function, pin 236 is selectively insertable through any one set, either set a, or set b, or set c. If pin 236 is inserted through set a, it passes inwardly through slots 234*a* provided in outermost weight 206 and intermediate weight 204 and then finally through hole 232*a* provided in innermost weight 202. Thus, only innermost weight 202 is linked to connecting pin 236. If pin 236 is lifted upwardly by virtue of being connected to some type of lifting device such as a lifting handle, it will carry with it only innermost weight 202, the other two weights 204 and 206 being left behind. Thus, inserting pin 236 through set a selects only innermost weight 202 as the exercise mass.

If pin 236 is inserted through set b of holes 232 and slots 234, pin 236 now passes through holes 232*b* in the innermost and intermediate weights, but passes through a slot 234*b* in outermost weight 204. Thus, raising pin 236 will now carry with it two weights instead of one, i.e. the innermost and intermediate weights 202 and 204, leaving outermost weight 206 on the floor. Thus, by disconnecting pin 236 from set a and inserting it through set b, the user will have selected both innermost weight 202 and intermediate weight 204 for use as the exercise mass, thus doubling the exercise mass from its first value when the weights 202 and 204 each have the same mass.

It should now be apparent what will happen if the user selects the third set c of holes 232 and slots 234 for use. Passing pin 236 through the third set c will cause it to be coupled simultaneously to all three weights 202, 204 and 206 in exercise weight system 200. Lifting pin 236 will now carry with it all three weights for use as the exercise mass.

This unique hole and slot system for use with a connecting member or pin that can be pushed through different sets of aligned holes and slots allows for a new way of connecting a series of nested weights together. As such, exercise weight system 200 of this invention forms a new type of nested weight stack that could be used on a conventional exercise bench or weight machine. For example, referring to FIGS. 8 or 9, exercise weight system 200 could replace the traditional vertical weight stack 62 with the innermost weight 202 being connected in some fashion to the lifting rope or cable of the exercise machine. The amount of weight attached to this rope or cable would then be adjustable through pin 236 simply by selecting a different set of aligned holes 232 and slots 234, i.e. by pushing pin 236 through set a, b or c. In this manner, the traditional vertical weight stack shown in FIGS. 8 or 9 where pin 68 passes beneath the lowest weight that is to be used is made obsolete by the nested weights 202, 204 and 206 of exercise weight system 200. Considerable space savings would result and pin 236 is always easily reached by the user.

Another way to use exercise weight system 200 of this invention is to provide that pin 236 be used to also couple the selected weights to some sort of handle. Thus, pin 236 includes an upwardly extending hook-shaped portion 238 that slides on a vertical arm 239 to couple the selected weights to the dumbbell shown in FIGS. 1–12 by hooking around the topmost side rail 36 on one side of the dumbbell. A button 240 is provided on arm 239 with a spring 242 extending down against a hub on hook-shaped portion 238 having a lateral tab 243. This structure can be used to allow hook-shaped portion 238 to be engaged and disengaged from the topmost side rail 36. During insertion of pin 236 through one of the sets a, b or c of holes 232 and slots 234, hook-shaped portion 238 can be raised against the force of the spring 242 by putting one's thumb on top of button 240 and lifting up on tab 243 as shown in FIG. 17, thus extending hook-shaped portion 238 upwardly to clear side rail 36. When pin insertion is completed and pin 236 is received inside one of the sets a, b or c of holes 232 and slots 234, the operator can let go of button 240 and lateral tab 243. Spring 242 will then cause hook-shaped portion 238 to descend and grip around the topmost side rail 36 of the innermost weight in the dumbbell. See the operational sequence shown in FIG. 21.

Preferably, hook-shaped portion 238 is not the only means for connecting pin 236 to the dumbbell, it serving primarily to prevent pin 236 from accidentally sliding out during use. Another means that can be used separately or in conjunction with hook-shaped portion 238 is to provide a channel 244 on the bottom of the dumbbell, i.e. by affixing channel 244 to the bottom of the outermost weight of the dumbbell (i.e. the weight having the outermost end plates 34). Channel 244 would have three spaced holes 246 placed in the front and back walls thereof to align with the sets a, b or c of holes 232 and slots 234 in exercise weight system 200 and would be sized to nest inside channel 210 of innermost weight 202. Thus, when pin 236 is inserted through any of the sets a, b or c of holes 232 and slot 234, it will also physically pass through one of the holes 246 in the front and back walls of channel 244 to provide a further interconnection or coupling between the selected weights and the dumbbell through pin 236. Such a channel 244 added to the bottom of the outermost weight or member could be applied to all the dumbbells shown in FIGS. 1–16, while hook-shaped portion 238 is usable only with those dumbbells having side rails 36.

When pin 236 is coupled to the dumbbell in some fashion, the dumbbell through grip 30 essentially becomes a lifting handle for the selected weights with the selected weights forming a means for providing additional weight to the dumbbell. The weight of the dumbbell can now be increased from its previous maximum by the number of increments provided by the individual weights 202, 204 and 206 of exercise weight system 200. If the previous maximum weight of the dumbbell was 90 pounds, and three weights 202, 204 and 206 of ten pounds each are used in exercise weight system 200, new maximum weights of 100, 110 or 120 pounds can be selected depending upon which set a, b or c of holes 232 and slots 234 is used to receive connecting pin 236. A scale or indicia could be applied to the outside of channel 210 of outermost weight 206 beneath the sets a, b or c to indicate to the user which set to use to obtain the total weight that is desired. Thus, the weight of any of the dumbbells shown in FIGS. 1–16 can be increased without increasing its height, but by increasing its length through the use of exercise weight system 200 of this invention as a kit in manner just described.

Exercise weight system 200 of this invention can also be used with a simple handle 250 that is not itself a weight adjustable dumbbell. Such a handle 250 includes a grip 252 extending between some type of spaced apart ends 254. Such a handle 250 would also preferably include an upper rail 256 for receiving hook-shaped portion 238 of pin 236. In addition, handle 250 would have a bottom channel 244 with a plurality of holes 246 aligned with the sets a, b or c of holes 23 and slots 234 so that connecting pin 236 would also extend physically through holes in bottom channel 244 of handle 250 to physically couple pin 236 to the handle at some location other than just for hook-shaped portion 238. As previously described, such a channel 244 with holes 246 is also desirably added to the outermost weight in the dumbbell of FIGS. 1–16, including the dumbbell shown in FIG. 17 in phantom, for the same purpose. However, channel 244 is hidden in FIG. 17 in conjunction with the dumbbell, but has been illustrated in FIG. 20 as part of the simple handle 250.

The means for connecting pin 236 to a lifting handle, whether to simple handle 250 or to the handle that is included as part of any of the dumbbells shown in FIGS. 1–16, can obviously vary from that shown and described herein. All that is required is that pin 236 be coupled to the lifting handle with enough strength to ensure that the selected weights in exercise weight system 200 be securely carried with the lifting handle.

Obviously, if a simple handle 250 as shown in FIG. 20 is used instead of the weight adjustable dumbbells as shown in FIGS. 1–16, then exercise weight system 200 does not form simply an add-on amount of weight, but forms the primary system of adjusting the dumbbell's weight. For example, referring to FIG. 20 used with a simple handle 250 that has minimal weight, the weight of the adjustable dumbbell is formed primarily by the weight increments provided by the selected weights 202, 204 and/or 206. Thus, again assuming weights of equal ten pound amounts and a simple handle 250 whose weight is negligible, exercise weight system 200 used in conjunction with handle 250 forms a dumbbell having a 10 pound, 20 pound or 30 pound weight, depending upon which of the weights is coupled to pin 236. The numbers of weights can be easily increased to any number to provide any amount of adjustability, as long as additional sets of holes 232 and slots 234 are provided in the overlying portions of the weights. Thus, ten weights or twelve weights can be included, to provide a dumbbell adjustable in 10 pound increments all the way up to 100 or 120 pounds. Moreover, when exercise weight system 200 is expanded in this manner, the expansion inherently increases the length of the dumbbell without a commensurate height increase, which is preferred from a usability standpoint.

If the number of weights in exercise weight system 200 is expanded in the fashion just described, then the number of sets of aligned holes 232 and slots 234 must be expanded as well to equal the number of weights that can be individually selected. Moreover, within each set, the aggregate or total number of holes 232 and slots 234 will equal the number of weights as well. In the example shown in the drawings of three weights 202, 204 and 206, there are three sets a, b and c of aligned holes 232 and slots 234 with a total or aggregate number of three holes 232 and/or slots 234 within each set. If a fourth weight were added, then four sets of aligned holes 232 and slots 234 would be used on the weights. One set would comprise one hole 232 in innermost weight 202 with three aligned slots 234 in the other weights, the next set would comprise two holes 232 in the innermost 202 and first intermediate weight 204 and slots 234 in the last intermediate 204 and outermost weight 206, the next set would comprise holes 232 in the innermost 202 and both intermediate weights 204 and a slot 234 only in outermost weight 206, and the last set would be all aligned holes 232 in all of the weights. Thus, one, two, three or four weights could be selected depending upon which set of aligned holes and slot is used.

The hole and slot arrangements described thus far, in which each set of aligned holes 232 and slots 234 has a uniquely different number of holes and slots 234, mechanically couples each selected weight to pin 236 by virtue of passing pin 236 through a hole 232 in each selected weight. While the weights 202, 204 and 206 are shown in a nested form that would be effective to carry with it all weights above the lowermost selected weight, by virtue of the vertically nesting channels 210 and by the outward inclination on end plates 212, this force arising from the vertically nesting arrangement is an additional force that holds the weights to together. If a nesting arrangement were not used in the weights, i.e. the outward inclination of end plates 212 was dispensed with so that end plates 212 were purely vertical and the bottom walls 214 of channels 210 were deleted, then picking up one weight would not necessarily carry with it the weights above. Even so, with the described numerically different arrangement of holes 232 and slots 234 with a hole 232 being provided in the overlying portions of each weight that is to be lifted, the invention would still be operable since pin 236 is mechanically coupled to each weight being lifted through hole 232. Thus, when pin 236 extends through set b in which holes 232 are provided in innermost weight 202 and intermediate weight 204 and a slot 234 is provided in outermost weight 206, then the mechanical connection between pin 236 and these two holes 232 will lift both innermost weight 202 and intermediate weight 204 but not outermost weight 206, whether the weights have nested end plates 212 and bottom walls 214 or not.

However, when the weights 202, 204 and 206 are nested, either by virtue of the inclined end plate orientation 212 or because channels 210 further include overlying bottom walls 214 or both, such that picking up one weight necessarily carries with it the weights above, a different type of hole and slot arrangement could be used. In this case, each set a, b or c of holes and slots 234 is still unique compared to one another, but this time the uniqueness resides in the spatial arrangement of holes 232 and slots 234 within each set and not in the numbers of holes and slots 234. In other words, each set of holes and slots 234 could comprise exactly the same number of holes and slots 234, i.e. one hole 232 with the rest being slots 234, except that the relative position of hole 232 within each set would be uniquely different for each set.

Such an alternative arrangement of holes 232 and slots 234 for the three weight arrangement of FIG. 17 is illustrated in FIG. 22. Each set a, b or c of holes 232 and slots 234 has one hole 232 and two slots 234, but hole 232 shifts its position from set to set. In set a, hole 232*a* is provided in innermost weight 202. In set b, hole 232*b* is provided in intermediate weight 204. In set c, hole 232*c* is provided in outermost weight 206. However, using this hole and slot arrangement will work equally as well as the other disclosed arrangement when the weights are nested so that lifting one carries with it the weights above it.

Assume for a moment that pin 236 is inserted through set b where pin 236 passes through hole 232*b* in intermediate weight 204. While pin 236 is not mechanically coupled to innermost weight 202 as it was in the other disclosed hole and slot arrangement when set b was selected, raising pin 236 will lift up on intermediate weight 204. This will cause innermost weight 202 to rise because the closed bottom wall of channel 210 on intermediate weight 204 will engage the bottom wall of channel 210 on innermost weight 202 and the inclination of end plates 212 likewise will lift innermost weight 202. Thus, in a nested configuration of this type, the only weight that has to be mechanically coupled to pin 236 is the lowermost desired weight, and the hole and slot arrangement of FIG. 22 could be thus used in place of that shown in FIG. 20.

The term "hole" as used in conjunction with FIGS. 17–22 and in the claims is meant to refer to any aperture having a downwardly facing bearing surface (i.e. the upper end of the hole) against which pin 236 engages to lift the weight having the hole, in distinction to the term "slot" which refers to any aperture having an open upper end that lacks such a downward facing bearing surface so that pin 236 simply moves up out of the slot without engaging the weight.

Various modification of this invention will be skilled to the art. If exercise weight system 200 is used in conjunction with a handle, the handle shape and construction can widely vary. In addition, how pin 236 is connected to the handle could change. For example, the disclosed hook-shaped portion 238 and bottom channel 244 could be dispensed with as long as some mechanical connection between the handle and pin 236 is used. Pin 236 could be magnetized to increase its holding force with the sets of holes and slots.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling with the scope of the invention as defined by the following claims. Thus, the scope of the invention is to be limited only by the appended claims.

We claim:

1. An exercise weight system having an adjustable exercise mass, which comprises:

(a) a plurality of individual weights each of which comprises:

(i) a pair of spaced apart weight plates including a first substantially vertical weight plate spaced from a second substantially vertical weight plate by a predetermined distance;

(ii) at least one interconnecting member extending between and rigidly affixed to the first and second weight plates for rigidly joining the weight plates together, and the weight plates and interconnecting member(s) of each weight being separate and distinct from the weight plates and interconnecting member(s) of the other weights such that the weight plates and interconnecting member(s) of each weight form a single unit;

(b) wherein the predetermined distance between the first and second weight plates of successive weights is progressively longer from an innermost weight to an outermost weight such that the weights can be nested together in a horizontally extending stack with the first weight plates being nested together on one side of the horizontal stack and the second weight plates being nested together on the other side of the horizontal stack; and (c) at least one connecting member which mechanically couples a desired number of weights for joint use without requiring that a user manually hold the weights together, wherein the connecting member is adjustable between different positions relative to the weights to allow the user to select different numbers of weights for joint use depending upon the position of the connecting member, thereby to adjust the exercise mass.

2. The exercise weight system of claim 1, wherein the interconnecting member(s) comprise two opposed side rails which extend between and are fixed to opposed sides of the first and second weight plates.

3. The exercise weight system of claim 1, wherein the interconnecting member(s) comprise a base member fixed to a bottom side of the first and second weight plates.

4. The exercise weight system of claim 3, wherein the base member comprises a U-shaped channel.

5. The exercise weight system of claim 4, wherein the channels of successive weights are each slightly narrower than one another to allow the channels to be transversely nested inside of one another.

6. The exercise weight system of claim 1, wherein each weight further includes at least some portions that vertically overlie one another, and wherein the connecting member is insertable relative to the weights to lift up on the vertically overlying portion on at least one weight to carry with it the one weight and all other weights having vertically overlying portions above the vertically overlying portion of the one weight.

7. The exercise weight system of claim 6, wherein the vertically overlying portions comprise a portion of the interconnecting member(s).

8. The exercise weight system of claim 7, wherein the interconnecting member(s) comprise two opposed side rails which extend between and are fixed to opposed sides of the first and second weight plates, the side rails on one side of the weight plate overlying one another and the side rails on the opposed side of the weight plate overlying one another.

9. The exercise weight system of claim 7, wherein the interconnecting member(s) comprise a U-shaped channel affixed to the bottom side of the weight plates with the channel having a flat horizontal wall and vertically extending front and back walls, and wherein the vertically overlying portions comprise the horizontal walls of the channels.

10. The exercise weight system of claim 9, wherein the channels face upwardly with the horizontal walls forming bottom walls of the channels.

* * * * *

UNITED STATES PATENT AND TRADEMARK OFFICE

CERTIFICATE OF CORRECTION

PATENT NO. : 5,971,899

DATED : October 26,1999

INVENTOR(S) : Carl K. Towley, III, et al.

It is certified that error appears in the above-identified patent and that said Letters Patent is hereby corrected as shown below:

On line 2 of the related U.S. Application Data section, "which is" should read --and--.

Signed and Sealed this

Sixteenth Day of May, 2000

*Attest:*

Q. TODD DICKINSON

*Attesting Officer*

*Director of Patents and Trademarks*